US007697710B2

(12) United States Patent
Yang

(10) Patent No.: US 7,697,710 B2
(45) Date of Patent: Apr. 13, 2010

(54) EARPHONE WITH A SOUND GUIDING TUBE

(75) Inventor: Bill Yang, Taipei (TW)

(73) Assignee: Cotron Corporation, Taipei (TW)

( * ) Notice: Subject to any disclaimer, the term of this patent is extended or adjusted under 35 U.S.C. 154(b) by 926 days.

(21) Appl. No.: 11/309,359

(22) Filed: Jul. 31, 2006

(65) Prior Publication Data

US 2007/0286446 A1 Dec. 13, 2007

(30) Foreign Application Priority Data

Jun. 9, 2006 (TW) ..... 95120518 A

(51) Int. Cl.
*H04R 25/00* (2006.01)
*H04R 5/02* (2006.01)

(52) U.S. Cl. ..... 381/382; 381/186; 381/309; 381/370; 381/380

(58) Field of Classification Search ..... 381/382
See application file for complete search history.

(56) References Cited

U.S. PATENT DOCUMENTS 4,347,405 A * 8/1982 Davis ..... 381/309
6,263,085 B1 * 7/2001 Weffer ..... 381/371
2005/0207606 A1 9/2005 Yang ..... 381/370
2005/0207607 A1 9/2005 Yang ..... 381/382

FOREIGN PATENT DOCUMENTS

| | | |
|---|---|---|
| EP | 0421681 | 4/1991 |
| EP | 0448110 | 9/1991 |
| EP | 0464220 | 1/1992 |
| EP | 1032243 | 8/2000 |
| FR | 2867938 | 9/2005 |
| WO | WO 97/11573 | 3/1997 |
| WO | WO 03/075604 | 9/2003 |

* cited by examiner

*Primary Examiner*—Curtis Kuntz
*Assistant Examiner*—Matthew Eason
(74) *Attorney, Agent, or Firm*—Jianq Chyun IP Office

(57) ABSTRACT

An earphone with a sound guiding tube is provided. The sound guiding tube has an external chamber beside the ear. Compared with a conventional earphone which transmits sound directly into the ear, the earphone of the present invention has a external chamber which forms sound field outside the ear and then transmits the sound into the ear through a sound guiding tube in a particular angle. The earphone of the invention is suitable for stereo sound source or multiple-channel sound sources and will reduce damage caused by wearing the earphone for a long time.

11 Claims, 7 Drawing Sheets

EARPHONE WITH A SOUND GUIDING TUBE

CROSS-REFERENCE TO RELATED APPLICATION

This application claims the priority benefit of Taiwan application serial no. 95120518, filed on Jun. 9, 2006. All disclosure of the Taiwan application is incorporated herein by reference.

BACKGROUND OF THE INVENTION

1. Field of the Invention

The present invention relates to an earphone. More particularly, the present invention relates to an earphone with a sound guiding tube which can form sound in the chamber of the sound guiding tube and transmit the sound into listener's ears.

2. Description of Related Art

The conventional earphone is to transmit the sound of a speaker directly into a listener's internal ears in 180°. If worn for a long time, the listener's internal ears may be damaged, for example, the audition of the listener may be impaired etc. FIG. 1 illustrates a conventional earphone. Referring to FIG. 1, according to the conventional earphone 100, the speaker is disposed on the earphone case 120 and connected to the sound source through the signal circuit 130. When the earphone 100 is used, the earphone case 120 and the speaker 110 thereon are inserted into the ear. Since the speaker 110 and part of the earphone case 120 have to be placed into the ear, the chamber size the speaker 110 can have in the earphone case 120 is strictly limited, thus, the sound effect of large space or multiple-channel sound effect cannot be achieved.

If a user wants to have the sound effect of large space or multiple-channel effect, large non-plug headphone can be used, as shown in FIG. 2. According to the conventional headphone 200, one or multiple speakers (not shown) are disposed in the large volume cases 210 and 220, and the headphone covers 212 and 222 transmit the sound into the listener's ear after signals are transmitted to the internal speakers through the signal circuit 230. However, compared to the earphone, such conventional headphone 200 is too large and is not suitable for today's popular portable music player or video player. Thus, how to allow a user to carry a small-sized and light-weighted portable music player or video player with a small-volume earphone having the effect of large space and multiple-channels has become the main objective of the industry.

SUMMARY OF THE INVENTION

Accordingly, the present invention is directed to provide an earphone with a sound guiding tube. The earphone with a sound guiding tube can form the sound produced by a speaker into a sound field in a chamber and transmit the sound through the sound guiding tube into the listener's internal ear in a particular angle, so as to reduce the risk of impairing listener's audition who wears the earphone for a long time.

According to the present invention, since the chamber of the earphone is placed outside of the ear, the size of the speaker can be adjusted according to the requirement and not limited by space.

According to the earphone provided by the present invention, when the earphone is used for receiving stereo sound source, as long as the capacity of the chamber is calculated for keeping an ideal audio waveform, the sound is not transmitted into the ear directly, so as to protect the ear. Besides, the volume of the chamber is not limited by the structure of the ear since the chamber is at the outside of the ear, thus, speakers of higher power and better performance can be used to meet the requirement.

According to the earphone provided by the present invention, the positions of the speakers can be adjusted, and the required capacity of the chamber can be calculated according to the characteristics of the sounds and frequencies of the speakers.

The earphone provided by the present invention has a composite chamber formed by an extension chamber, so as to adjust the positions of the speakers by using different extension tubes and to calculate the required chamber volume according to the sounds and frequencies of the speakers.

According to the earphone provided by the present invention, a chamber is added to the exterior of the extension tube to increase independent sound field, and the chamber forms a composite sound field with the main chamber formed inside the external chamber sound guiding tube.

In order to make the aforementioned and other objects, features and advantages of the present invention comprehensible, a preferred embodiment accompanied with figures is described in detail below.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
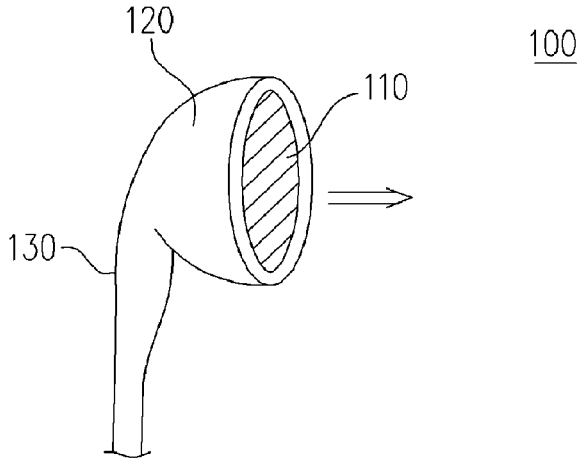
FIG. 1 (PRIOR ART)
FIG. 1 illustrates a conventional earphone.
Figure 2:
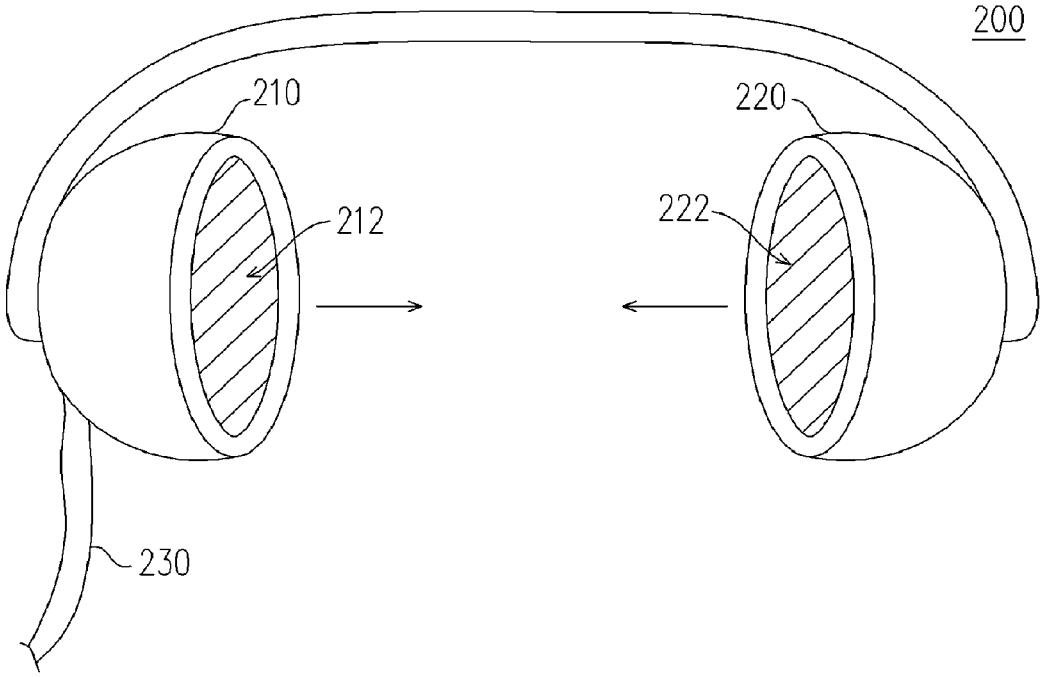
FIG. 2 (PRIOR ART)
FIG. 2 illustrates a conventional headphone.

The present invention provides an earphone with a sound guiding tube, which is different from a conventional earphone that directly transmits sound produced by a speaker into the internal ear in about 180°. According to the earphone provided by the present invention, the speaker is disposed in a particular angle, for example, in 90° to the internal ear, and the sound produced by a speaker is formed into sound field in the chamber and transmitted to the internal chamber of the listener's internal ear through the sound guiding tube, so as to reduce the damage to the listener's internal ear caused by wearing the earphone for a long time, such as damage to the listener's audition. For example, nowadays MP3 players and IPod music players are very popular; however, they may impair users' audition if worn for long time.

The earphone with sound guiding tube provided by the present invention is different from the conventional earphone. The chamber of the earphone in the present invention is placed outside of the auricle, thus, the chamber can be adjusted according to the requirement and is not limited by space. Accordingly, the earphone in the present invention is suitable for stereo speaker or multiple-channel speaker which is composed of a plurality of speakers.

When the earphone in the present invention is used for receiving stereo sound source, the ear can be protected as long as appropriate chamber volume is calculated to maintain an ideal audio waveform instead of directly transmitting sound into the ear. While the conventional earphone is placed in the auricle of the user and whether the speaker used will affect the user has to be considered, thus, the conventional earphone is limited to certain extent, for example, speaker of smaller power has to be used. As to the earphone with sound guiding tube in the present invention, since the chamber thereof is at the outside of the auricle, the volume of the chamber is not limited by the structure of the internal ear, thus, speakers of higher power and better performance can be adopted to meet the requirement.

If the earphone with sound guiding tube in the present invention is used in multiple-channel system, the chamber thereof can be adjusted according to the positions of the speakers and produce optimized sound field according to the characteristics of the speakers. In addition, in a multiple-channel earphone, aggravated surrounding or aggravated bass sound effect can be produced effectively by adjusting the proportion between the height and the width inside the chamber. That is, the tube diameter of the sound guiding tube is adjusted according to the calculated sound guiding volume required to be produced by the sound guiding tube to achieve the required sound quality and volume. The abovementioned technology of improving sound quality by adjusting the chamber volume can be referred to the Republic of China (ROC) Patent Applications filed by the Inventor of the present invention: No. 93107621, titled "Earphone with Composite Sound Field", filed 22$^{nd}$ Mar., 2004; and the following US Patent No. 2005/0207606, titled "Earphone structure with Composite Sound Field", filed 9$^{th}$ Jun., 2004; US Patent No. 2005/0207607, titled "Multiple-Channel Earphone", filed 17$^{th}$ Mar., 2005; and U.S. Pat. Ser. No. 11/308,902, titled "Multiple-Channel Earphone", filed 24$^{th}$ May, 2006. The content of the previous disclosures are added herein, therefore, the details will not be described again.

Below the earphone with sound guiding tube provided by the present invention and various designs thereof with different sound guiding tube structures will be described with reference to a few embodiments. The earphones described below include earphone for receiving stereo sound source and earphone for receiving multiple-channel sound source.

Figure 3:
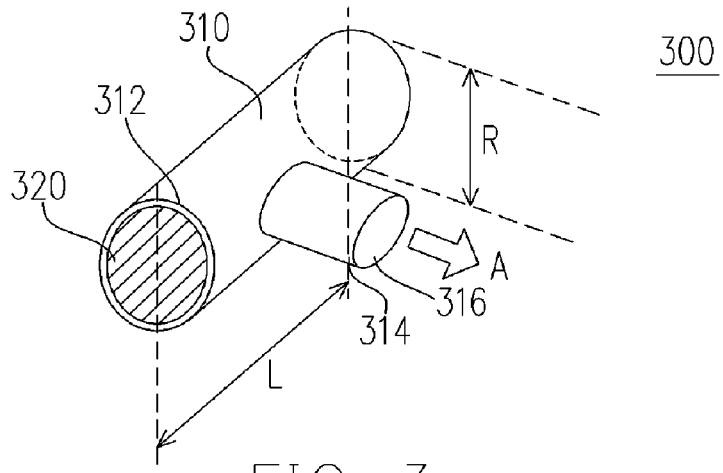
FIG. 3 illustrates an earphone with a sound guiding tube according to an embodiment of the present invention.

Refer to FIG. 3, which only illustrates one side of an earphone with sound guiding tube according to an embodiment of the present invention, however, those skilled in the art should be able to understand that the structure of the other side which is not shown is the same as the side illustrated herein, therefore will not be described again. The earphone 300 includes an external chamber 310 having a hole 312 for disposing stereo speaker 320 and an in-ear type sound guiding tube 314 to be inserted into user's auricle. The in-ear type sound guiding tube 314 is placed into user's auricle in direction A, and sound is transmitted into the user's ear through the phonating hole 316 of the in-ear type sound guiding tube 314. The chamber volume required can be calculated according to the sound and frequency of the speaker 320. The chamber volume can be calculated according to the length L and internal diameter R of the sound guiding tube 310 and the length and internal diameter of the in-ear type sound guiding tube 314.

Figure 4A:
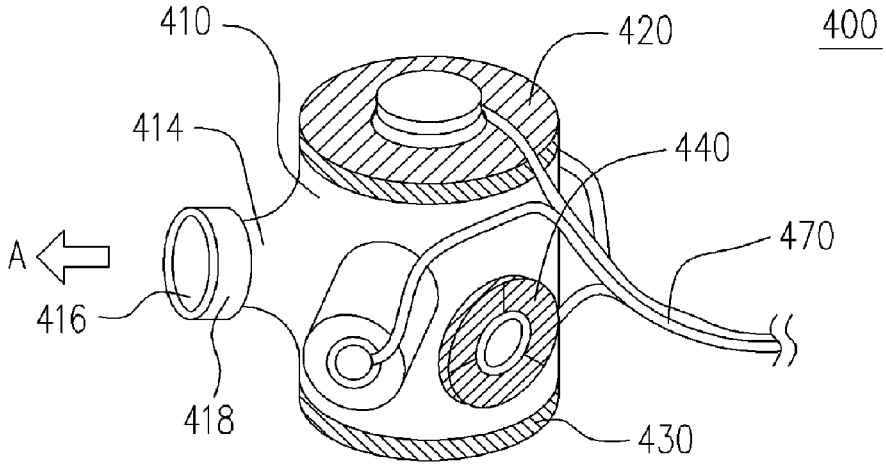
FIG. 4A and FIG. 4B illustrate an earphone with a sound guiding tube according to another embodiment of the present invention.
Figure 4B:
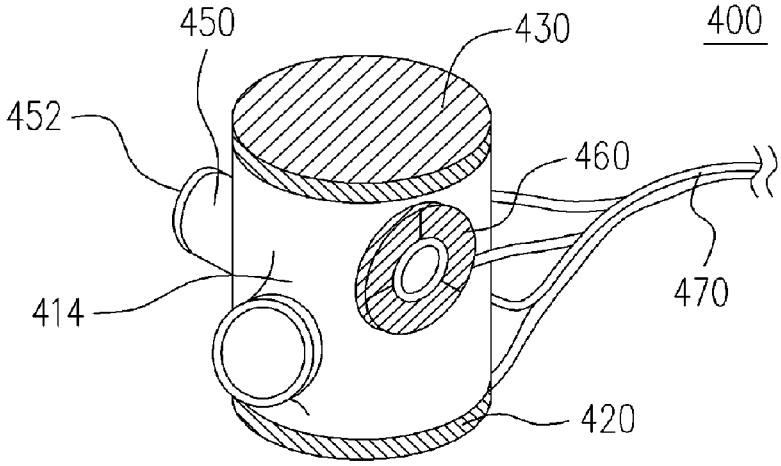

Speakers of large power can be used in the earphone with sound guiding tube of the present invention, and aggravated surrounding and aggravated bass sound effect can be effectively produced by adjusting the proportion between the height and width inside the external chamber. FIG. 4A and FIG. 4B illustrate an earphone with a sound guiding tube according to another embodiment of the present invention. The earphone structure illustrated in FIG. 4B is the side view of the earphone structure illustrated in FIG. 4A reversed 180°, and only one side of the earphone is illustrated in FIG. 4A and FIG. 4B, however, it should be understood by those skilled in the art that the structure of the other side of the earphone is the same therefore will not be described herein.

The earphone 400 includes a cylinder-shaped external chamber 410, a multiple-channel speaker 420 disposed in a side hole, and an in-ear type sound guiding tube 414 which can be placed into user's auricle. Material absorbing reflected sound, such as sound-absorbing sponge, can be disposed at the opposite side to whereon the speaker 420 is disposed in the external chamber 410 for absorbing the reflected sound, so as to prevent the volume of the speaker 420 from going too high, which may produce reflected sound inside the external chamber 410 and affect the quality of the sound, and such method can be used for, for example, noise processing.

The in-ear type sound guiding tube 414 is placed into the user's auricle in direction A, and the sound is transmitted into the user's ear by the phonating hole 416 of the in-ear type sound guiding tube 414. To allow the user wearing the earphone more comfortably, the front end of the in-ear type sound guiding tube 414 can be fixed to the outside of the phonating hole 416 by a plastic soft pad 418. As shown in the figure, the speaker 420 obtains signals from the signal circuit 470, and the speaker 420 can be speaker of large power according to the size of the external chamber 410.

Moreover, sound-absorbing material 430, such as sound-absorbing sponge, can be disposed at another opposite side to whereon the speaker 420 is disposed in the external chamber 410 for absorbing the reflected sound, so as to prevent the volume of the speaker 420 from going too high, which may produce reflected sound inside the external chamber 410 and affect the quality of the sound, and the method can be used for, for example, noise processing.

A plurality of speakers suitable for multiple-channel sound sources can also be disposed at the outside of the external chamber 410 to work with, for example, the 5.1 channel sound source of a digital video disc (DVD). Certainly, the present invention is not limited to 5 speakers; instead, speakers can be added according to the user's requirement to sound quality, or sound source of other audio or video devices can be adopted, such as the sound source of 6.1 channels or even 7.1 channels. For example, the speakers 440 and 460 as illustrated, or an extension chamber 450 disposed at outside of the external chamber 410 and another speaker 452 are added to the outside of the extension chamber 450. The disposition of such speakers can be adjusted according to the environmental or bass sound effect required by the earphone 400. Regarding the design of multiple-channel sound source earphones, please refer to the foregoing patent applications filed by the Inventor of the present invention, and the details will not be described herein.

The required chamber volume of the earphone 400 can be calculated according to the sound and frequency characteristics of the speakers 420, 440, 452, and 460, or the speakers added according to design requirement. The chamber volume can be adjusted by adjusting the height and internal diameter of the cylinder-shaped external chamber 410.

Below the earphone with sound guiding tube in the present invention applied to multiple-channel system will be described, wherein the chamber of the earphone can be adjusted according to the positions of the speakers so as to produce the optimized sound field according to the characteristics of the speakers. Moreover, the size of the tube is adjusted according to the calculated sound field required to be produced by the external chamber, so as to achieve the required sound quality and volume.

Figure 5A:
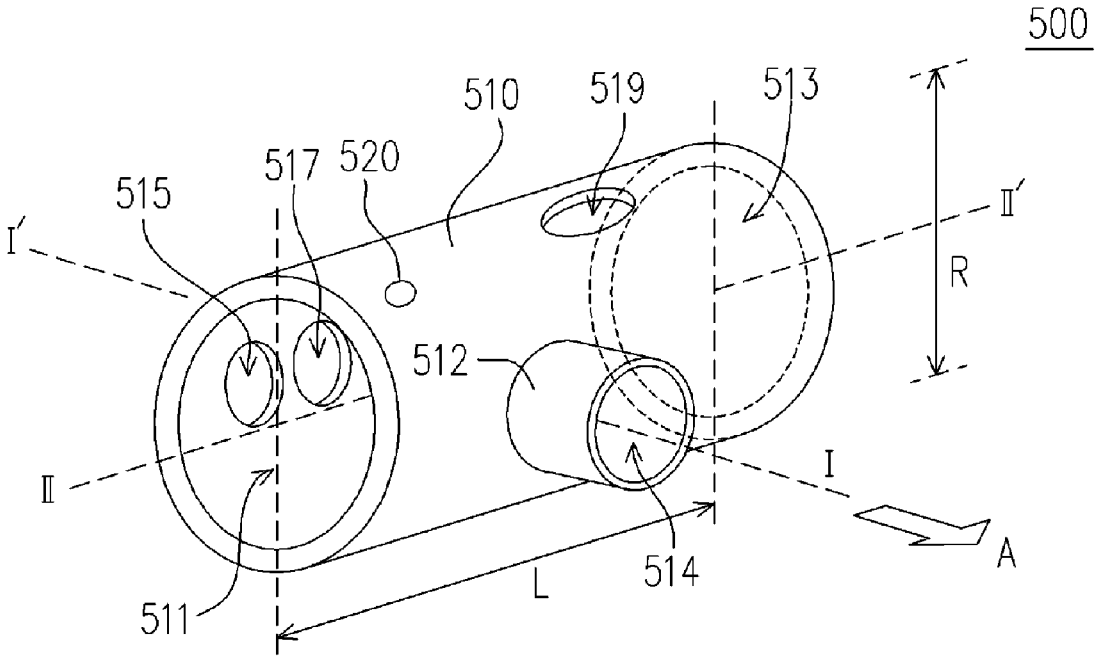
FIGS. 5A~5E illustrate an earphone with a sound guiding tube according to yet another embodiment of the present invention.
Figure 5B:
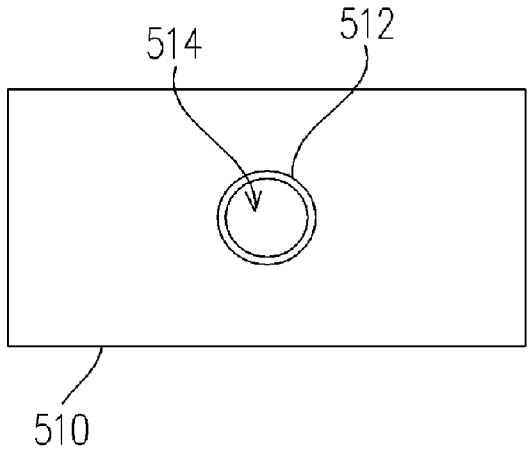
Figure 5C:
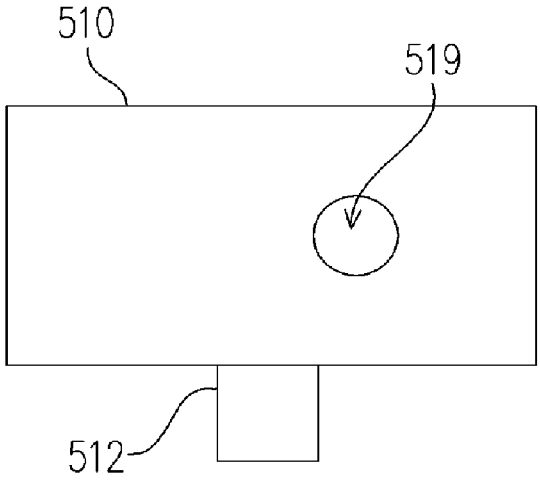
Figure 5D:
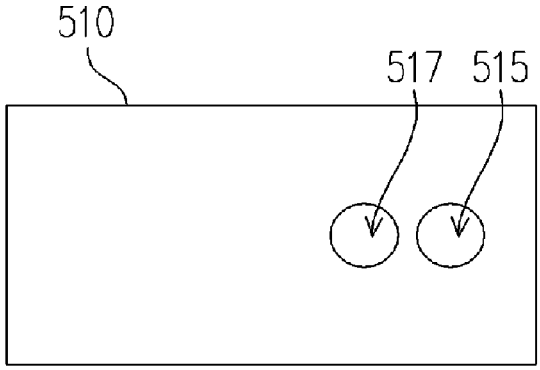
Figure 5E:
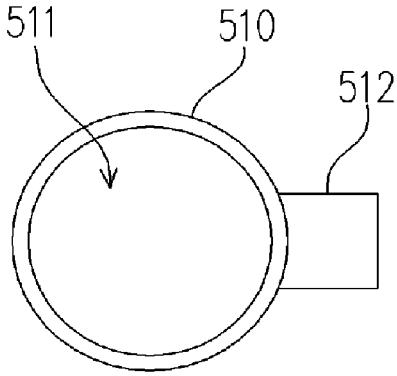

FIG. 5A illustrates an earphone with a sound guiding tube according to yet another embodiment of the present invention. Only one side of the earphone in the present invention is illustrated in FIG. 5A, however, it should be understood by those skilled in the art that the structure of the other side of the earphone is the same therefore will not be described herein. The earphone 500 includes an external chamber 510 having holes 511, 513, 515, 517, and 519 for disposing speakers of multiple channels. The earphone 500 further includes an in-ear type sound guiding tube 512 which can be placed into the user's auricle and a phonating hole 514. The earphone 500 is placed into the user's auricle in direction A, and the sound is transmitted into the user's ear through the hole 514 of the in-ear type sound guiding tube. The required chamber volume of the earphone 500 can be calculated according to the sound and frequency characteristics of the speakers. The chamber volume can be calculated according to the length L and internal diameter R of the external chamber 510 and the length and internal diameter of the in-ear type sound guiding tube 514. To understand the structure of the earphone 500 better, FIG. 5B is the front view of earphone 500 in direction I-I', FIG. 5C is the top view of earphone 500 in direction I-I', FIG. 5D is the rear view of earphone 500 in direction I-I', and FIG. 5E is left view of earphone 500 in direction I-I', which is, in direction II-II'.

In the present embodiment, the holes 511, 513, 515, 517, and 519 for disposed speakers on the external chamber 510 are disposed mainly according to the 5.1 channel sound source of a digital video disc (DVD). Certainly, the present invention is not limited to the disposition of five speakers; instead, more speakers can be added according to the user's requirement to sound quality or the sound source of other audio or video devices can be adopted, such as sound source of 6.1 channel or even 7.1 channel; and the number of speakers is adjusted according to requirement. The positions whereon the holes 511, 513, 515, 517, and 519 for disposed speakers are disposed can be adjusted according to the characteristics of the speakers to produce optimized sound field. For example, if as shown in FIG. 5A, a first and a second main speakers are respectively disposed at the positions of the holes 513 and 517, a subwoofer is disposed at the position of the hole 515, a surrounding speaker is disposed at the position of the hole 511, and a center speaker is disposed at the position of hole 519.

In an embodiment, a hole set composed of a small hole or a group of holes can be formed on the external chamber 510, as denoted by number 520, for releasing the sound pressure formed in the external chamber, so as to achieve better sound field effect.

The present invention provides an earphone with a sound guiding tube, the earphone has a composite chamber formed by an extension chamber, wherein the positions of speakers can be adjusted by using different extension tubes, and the required chamber volume is calculated according to the sound and frequency characteristics of the speakers.

Figure 6:
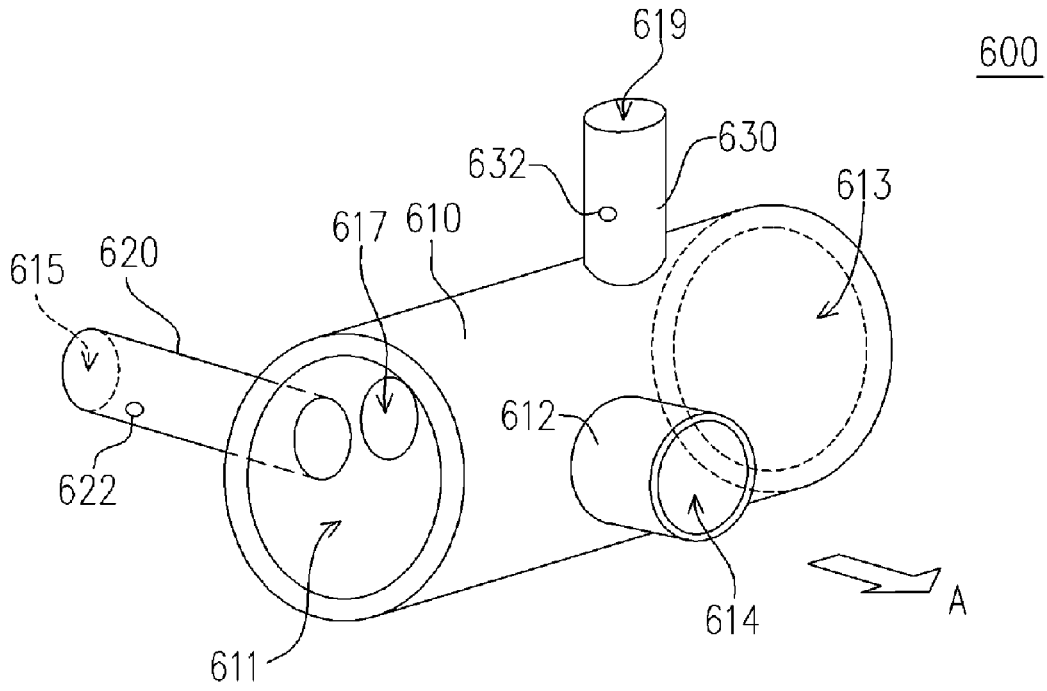
FIG. 6 illustrates an earphone with a sound guiding tube according to yet another embodiment of the present invention.

FIG. 6 illustrates an earphone with a sound guiding tube according to yet another embodiment of the present invention. Only one side of the earphone in the present invention is illustrated in FIG. 6, however, it should be understood by those skilled in the art that the structure of the other side of the earphone is the same therefore will not be described herein. The earphone 600 includes an external chamber 610 having holes 611, 613, 615, 617, and 619 for disposing speakers of multiple channels. The earphone 600 further has an in-ear type sound guiding tube 612 which can be placed into user's auricle and a phonating hole 614. The earphone 600 is placed into the user's auricle in direction A, and the sound is transmitted into the user's ear through the hole 614 of the in-ear type sound guiding tube 612. The difference between the earphone 600 and the earphone in FIG. 5A is that extension tubes are added to form the composite chamber. As shown in the figure, the holes 615 and 619 for disposing the speakers are respectively located at the ends of the extension tubes 620 and 630.

Besides calculating the required chamber volume according to the sound and frequency characteristics of the speakers, different chambers can be formed according to the extension tubes 620 and 630. A main chamber is formed in the external chamber 610, extension chambers are respectively formed by the extension tubes 620 and 630, and the required chamber volume is calculated according to the sound and frequency characteristics of the speakers.

In an embodiment, a hole set composed of a small hole or a group of holes can be formed on the extension tubes 620 and 630 for releasing sound pressure and to achieve better sound field effect.

Figure 7:
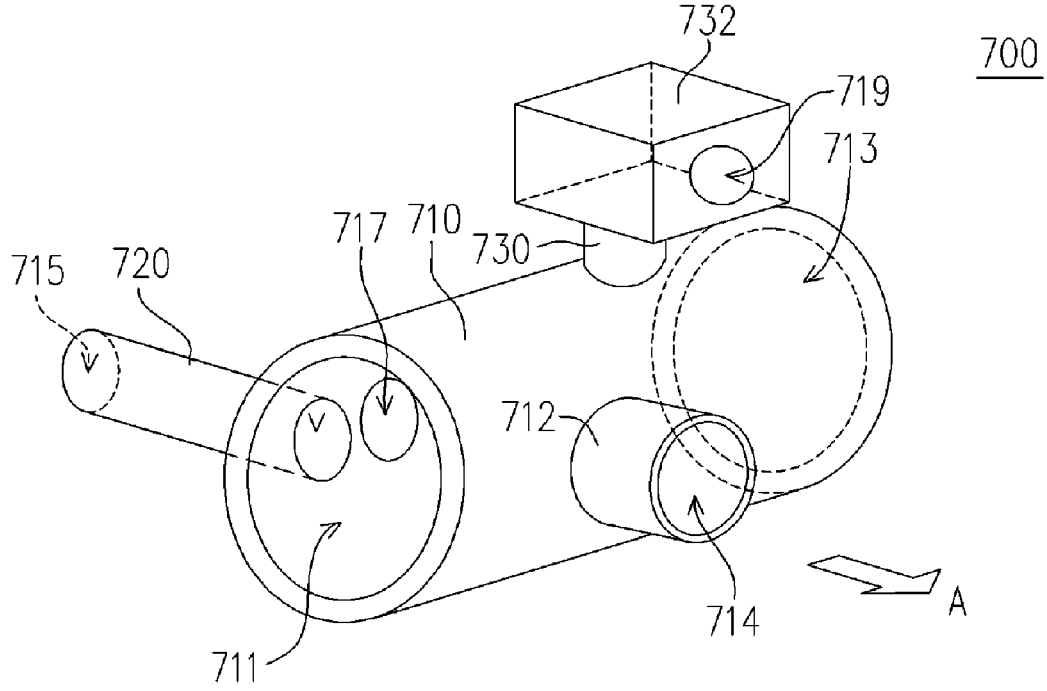
FIG. 7 illustrates an earphone with a sound guiding tube according to yet another embodiment of the present invention.

FIG. 7 illustrates an earphone with a sound guiding tube according to yet another embodiment of the present invention. Only one side of the earphone in the present invention is illustrated in FIG. 7, and the structure of the other side of the earphone is the same as that shown in FIG. 7, therefore, the details will not be described herein. The earphone 700 includes an external chamber 710 having holes 711, 713, 715, 717, and 719 for disposed speakers of multiple channels. The earphone 700 further includes an in-ear type sound guiding tube 712 which can be placed in user's auricle and a phonating hole 714. The earphone 700 is placed into the user's auricle in direction A, and the sound is transmitted into the user's ear through the hole 714 of the in-ear type sound guiding tube 712. The difference between the earphone 700 and the earphone in FIG. 5A is that extension tubes are added to from the composite chamber. As shown in the figure, the hole 715 for disposing the speaker is located at the end of the extension tube 720.

Besides, the difference between the earphone 700 and the earphone in FIG. 6 is that the a sound chamber 732 is further added after the extension tube 730, and the hole 719 for disposing the speaker is located on the sidewall of the sound chamber 732. Besides calculating the required chamber volume according to the sound and frequency characteristics of the speakers, an independent sound field can be formed in the sound chamber 732 according to the different chambers formed by the extension tube 720. A main chamber is formed in the external chamber 710, and extension chambers are respectively formed by the extension tube 720 and the inside of the sound chamber 732, so as to form a composite sound field. The required chamber volume is calculated according to the sound and frequency characteristics of the speakers.

Figure 8A:
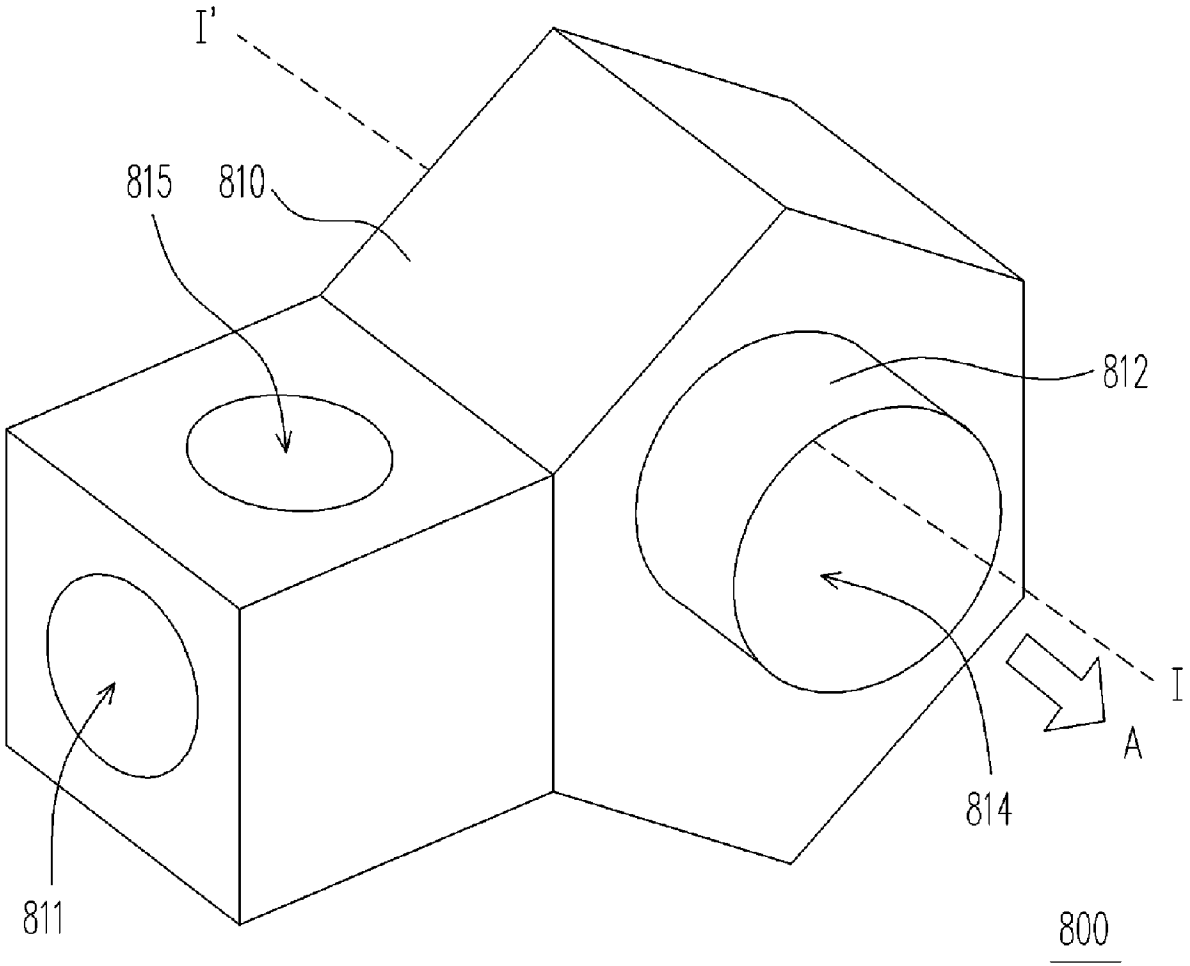
FIG. 8A illustrates an earphone with a sound guiding tube according to yet another embodiment of the present invention.
Figure 8B:
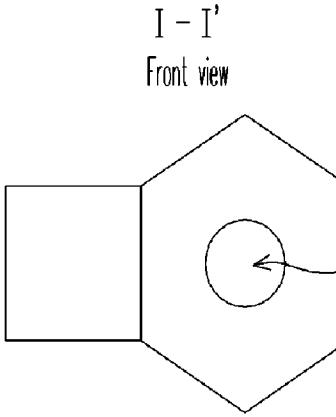
FIGS. 8B~8G are views of the earphone from various angles.
Figure 8C:
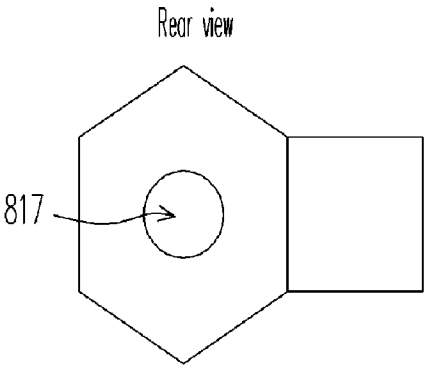
Figure 8D:
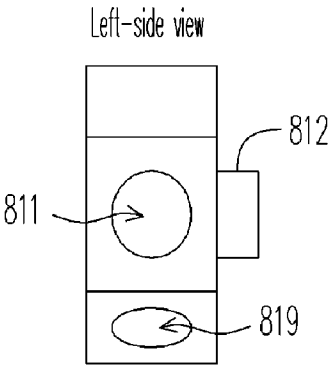
Figure 8E:
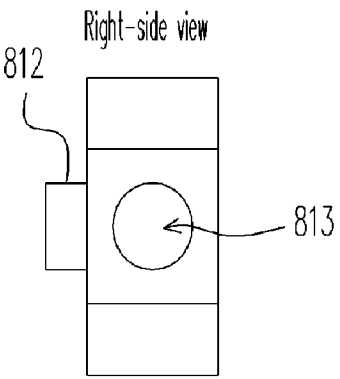
Figure 8F:
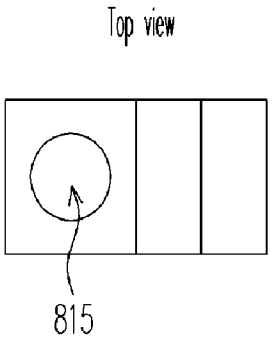
Figure 8G:
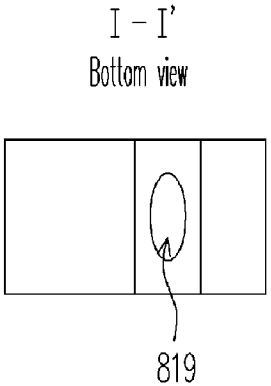

According to the present invention, the earphone with sound guiding tube can be designed with different appearances for the convenience of users. For example, as shown in FIG. 8A, the earphone is designed into a 3-D hexagon. FIG. 8A only illustrates one side of an earphone provided by the present invention, however, it should be understood by those skilled in the art that the structure of the other side of the earphone is the same as that illustrated in FIG. 8A, therefore, the details will not be described herein. The earphone is described here with reference to the views from various points as shown in FIGS. 8A~8F. Here FIG. 8B is the front view thereof in direction I-I', FIG. 8C is the rear view thereof in direction I-I', FIG. 8D is the left view thereof in direction I-I', FIG. 8E is the right view thereof in direction I-I', FIG. 8F is the top view thereof in direction I-I', and FIG. 8G is the bottom view thereof in direction I-I'.

The multiple-channel earphone 800 with sound guiding tube includes a 3-D external chamber 810 having holes 811, 813, 815, 817, and 819 for disposing speakers of multiple channels, and a chamber therein corresponding to the external chamber sound guiding tube. The multiple-channel earphone 800 with sound guiding tube further includes an in-ear type sound guiding tube which can be placed into user's auricle and a phonating hole 814. The earphone 800 is placed into the user's auricle in direction A, and the sound is transmitted into the user's ear through the hole 814 of the in-ear type sound guiding tube 812. The required chamber volume of the earphone 800 can be calculated according to the sound and frequency characteristics of the speakers. The chamber volume can be calculated according to the length L and internal diameter R of the external chamber sound guiding tube in the 3-D chamber 810 and the length and internal diameter of the in-ear type sound guiding tube 814.

In the present embodiment, the holes 811, 813, 815, 817, and 819 on the 3-D chamber 810 for disposing speakers are disposed mainly according to the 5.1 channel sound source of a digital video disc (DVD). Certainly, the present invention is not limited to the disposition of five speakers; instead, more speakers can be added according to the user's requirement to sound quality, or sound source of other audio or video devices may be adopted, for example, sound source of 6.1 channel or even 7.1 channel; and the number of speakers is adjusted according to the requirement.

The positions of the holes 811, 813, 815, 817, and 819 for disposing speakers can be adjusted according to the characteristics of the speakers to produce the optimized sound field. For example, if the positions of the holes 811 and 817 are disposed according to the 5.1 channel sound source of a DVD, the first and the second main speakers are disposed at the positions of the holes 811 and 817, the sub-woofer can be disposed at the position of the hole 819, the surrounding speaker can be disposed at the position of the hole 813, and the center speaker can be disposed at the position of the hole 815.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An earphone with a sound guiding tube, comprising:

an external chamber;

an in-ear type sound guiding tube, connected to the external chamber, to be placed in a user's ear;

a first speaker, disposed at a first side of the external chamber, a second side of the external chamber being blocked to form a space in the external chamber, the sound produced by the first speaker forming a sound field in an inner space of the external chamber and then being transmitted into the user's ear through the in-ear type sound guiding tube;

a second speaker and a third speaker, both of which are disposed on a surrounding side of the external chamber except for the first side and the second side;

an extension chamber, disposed at outside of the external chamber and having a communicating channel with the inner space of the external chamber; and a fourth speaker, disposed inside the external chamber.

2. The earphone as claimed in claim 1, wherein the in-ear type sound guiding tube is inserted into the user's ear in a first direction, and the direction in which the first speaker produces a sound forms a predetermined angle with the first direction.

3. The earphone as claimed in claim 2, wherein the predetermined angle is 90°.

4. The earphone as claimed in claim 1, wherein the capacity of the external chamber is determined according to the sound and frequency of the first speaker.

5. The earphone as claimed in claim 1, wherein a plastic pad is fixed to the exterior of the front end of the in-ear type sound guiding tube for the convenience of the user.

6. The earphone as claimed in claim 1, wherein the second side of the external chamber is blocked with a sound-absorbing material to receive sound produced by the first speaker, so as to prevent reflected sound from being produced in the chamber inside the external chamber, which affects the quality of the sound.

7. The earphone as claimed in claim 1, wherein the capacity of the external chamber is determined according to the sounds and frequencies of the first speaker, the second speaker, the third speaker, and the fourth speaker.

8. An earphone with a sound guiding tube, comprising:

an external chamber;

an in-ear type sound guiding tube, connected to the external chamber, to be placed in a user's ear;

a plurality of speakers, respectively disposed at both sides and the exterior of the external chamber according to the characteristics of the speakers, an inner space being formed in the external chamber, the sounds produced by the speakers forming sound fields in the inner space inside the external chamber and being transmitted into the user's ear through the in-ear type sound guiding tube; and an extension chamber disposed outside of the external chamber, one of the speakers being disposed in the extension chamber, the extension chamber having a communicating channel with the inner space inside the external chamber, and a further space inside the extension chamber and the inner space inside the external chamber forming a composite chamber.

9. The earphone as claimed in claim 8, wherein the method for disposing the speakers at both sides and the exterior of the external chamber according to the characteristics of the speakers is to dispose the speakers according to the 5.1 channel sound source provided by a digital video disc (DVD).

10. The earphone as claimed in claim 8 further comprising: a sound chamber, disposed outside of the external chamber, the sound chamber having a second communicating channel with the inner space inside the external chamber.

11. The earphone as claimed in claim 10, wherein one of the speakers is disposed in the sound chamber, wherein a capacity of an inner space of the sound chamber is determined according to the sounds and frequencies of the speaker disposed inside the sound chamber.

* * * * *